United States Patent [19]

Meier

[11] 4,408,755

[45] Oct. 11, 1983

[54] METHOD AND APPARATUS FOR FORMING MULTI-SHEET PRINTED PRODUCTS, ESPECIALLY NEWSPAPERS AND MAGAZINES

[75] Inventor: Jacques Meier, Bäretswil, Switzerland

[73] Assignee: Ferag AG, Hinwil, Switzerland

[21] Appl. No.: 235,661

[22] Filed: Feb. 17, 1981

[30] Foreign Application Priority Data

Mar. 11, 1980 [CH] Switzerland ..... 1888/80

[51] Int. Cl.[3] ..... B65H 39/00

[52] U.S. Cl. ..... 270/52; 270/39; 270/57

[58] Field of Search ..... 270/39, 53, 52, 57; 226/104–107

[56] References Cited

U.S. PATENT DOCUMENTS

| | | | |
|---|---|---|---|
| 674,356 | 5/1901 | Feister | 270/39 X |
| 2,729,445 | 1/1956 | Webster | 270/39 |
| 3,122,362 | 2/1964 | Vollrath | 270/57 |
| 4,032,131 | 6/1977 | Davis | 270/53 |

FOREIGN PATENT DOCUMENTS

| | | | |
|---|---|---|---|
| 1408247 | 7/1965 | France | 270/39 |

*Primary Examiner*—A. J. Heinz
*Attorney, Agent, or Firm*—Werner W. Kleeman

[57] ABSTRACT

Multi-sheet printed products are formed in that a multiplicity of zig-zag configured folded webs aligned with respect to one another are deposited upon one another. Each web is formed by individual sheets which are interconnected with one another at fold locations extending transversely with respect to the lengthwise direction of the web. For supporting the webs which are to be placed upon one another there is provided a drum containing radially protruding support ribs at its circumference. Initially, the first web is placed upon the support ribs such that each second fold location comes to bear upon a support rib. The first web guided in a spiral-shaped formation upon the drum arrives at an infeed portion or section of the next following web where the second web, in the same manner as the first web, is placed thereover onto the support ribs. Both of the superimposed webs are guided along a screw or helical-shaped path, if desired to further infeed or inlet portions and finally to a removal portion or section where the structure formed of the superimposed webs is removed from the drum. The finished multisheet printed products, which are formed by the superimposed bearing sheets of the individual webs and are still hanging at one another, are then separated from one another individually or in packages. Since the individual superimposed sheets remain interconnected with one another until formation of the finished printed product, the sheets need not be individually manipulated, rather can be handled in their composite formation.

28 Claims, 7 Drawing Figures

METHOD AND APPARATUS FOR FORMING MULTI-SHEET PRINTED PRODUCTS, ESPECIALLY NEWSPAPERS AND MAGAZINES

CROSS-REFERENCE TO RELATED APPLICATION

This application is related to the commonly assigned, copending United States application Ser. No. 06/235,650, filed Feb. 17, 1981, entitled "Method and Apparatus For Gathering Together Sheets or the Like into Multi-Sheet Printed Products, Especially Newspapers and Magazines".

BACKGROUND OF THE INVENTION

The present invention relates to a new and improved method of, and apparatus for, forming multi-sheet printed products, especially newspapers and magazines.

To form multi-sheet printed products, such as newspapers and magazines, it is already known in this technology to withdraw individually printed sheets from stacks and to place them upon one another. In order to be able to bring the individual sheets in the correct position upon one another there is required a correspondingly great expenditure in machinery and control equipment.

SUMMARY OF THE INVENTION

Therefore, with the foregoing in mind it is a primary object of the present invention to provide a new and improved method of, and apparatus for, forming multi-sheet printed products, especially although not exclusively newspapers and magazines, in a most simple and reliable manner.

Another and more specific object of the present invention aims at providing a new and improved method of, and apparatus for, the efficient, accurate and reliable formation of multi-sheet printed products.

Still a further significant object of the present invention is to provide a new and improved construction of apparatus for forming multi-sheet printed products, which apparatus is relatively simple in construction and design, extremely reliable in operation, economical to manufacture, not readily subject to breakdown or malfunction, and requires a minimum of maintenance and servicing.

Now in order to implement these and still further objects of the invention, which will become more readily apparent as the description proceeds, the method for the formation of multi-sheet printed products, especially newspapers and magazines, is manifested by the features that at least two zigzag shaped, folded webs, each of which is formed by sheets interconnected with one another at fold locations or fold lines extending transverse to the web lengthwise direction, are deposited in aligned condition upon one another, and these webs are supported at spaced locations at the fold locations, preferably at each second fold location.

As already alluded to above the invention is not only concerned with the aforementioned method aspects but also relates to novel apparatus for the performance thereof, wherein there is provided a support device for the spaced supporting of at least two zig-zag shaped, folded webs which are superimposed upon one another in aligned condition. Each of the webs are formed by sheets interconnected with one another at fold locations or folds extending transversely with respect to the web lengthwise direction. The supporting of the superimposed webs is accomplished at the fold locations, preferably at each second fold location.

Since the individual sheets, which in each case form a zig-zag folded web, are interconnected with one another, the mutual position of the sheets of a web is always defined. During the formation of multi-sheet printed products it is therefore unnecessary during placement of the sheets upon one another to individually handle the sheets, rather they can be superimposed upon one another conjointly in their composite formation.

Preferably, the webs during such time as they are placed upon one another are guided along a helical or screwshaped path, so that there is rendered possible a continuous bringing together of the webs.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Describing now the drawings, it is here mentioned that based upon FIGS. 1 to 4 there initially will be described the zig-zag folding and subsequent stacking of a printed paper web.

Figure 1:
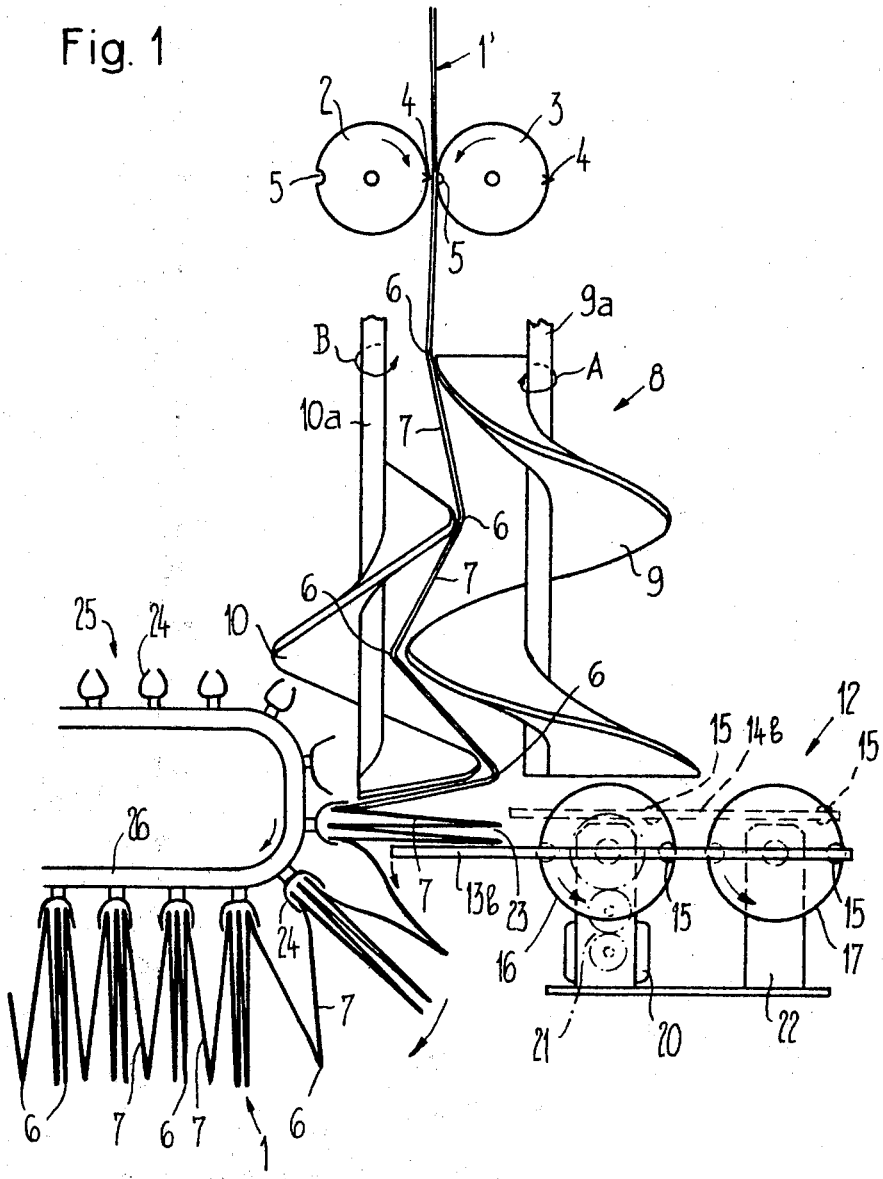
FIG. 1 is a side view of apparatus for the zig-zag shaped folding of a printed paper web.

Turning attention now specifically to FIG. 1, reference character 1' designates a printed paper web assumed to arrive from a rotary printing machine or press. This paper web 1' now travels between two schematically illustrated folding or fold rolls 2 and 3 which are driven to rotate in opposite sense, as the same has been schematically represented by the arrows. Each folding roll or roller 2 and 3 possesses a folding knife 4 and a folding groove or channel 5. During the rotation of the folding rolls 2 and 3, as is well known, the folding knife 4 of the one folding roll comes into engagement with the folding groove 5 of the other folding roll, whereby a fold is formed in the paper web 1'. The fold locations or lines which have been formed in this manner have been designated by reference character 6. It is also possible to construct the folding knife 4 as a perforating knife or cutter, so that there is produced a perforation at the fold locations or folds 6. Moreover, it is possible to structure the folding knife 4 in a manner such that the paper web 1' is cut at the fold locations or lines 6 from both marginal sides towards the centre over a portion of its width. The individual sheets interconnected with one another at the fold locations or lines 6 have been conveniently designated by reference character 7.

As best seen by referring to FIGS. 1 and 2, a folding device or apparatus 8 is arranged below the folding rolls or rollers 2 and 3 and serves for the zig-zag shaped folding of the paper web 1'. This folding device 8 will be seen to comprise a first folding worm 9 having a large diameter, this worm rotating in the direction of the arrow A about its shaft or axis 9*a*. Arranged opposite this first folding worm 9 are two folding worms 10 and 11 having smaller diameter, which are rotatably driven to rotate about their respective shaft or axis 10*a* and 11*a*, as the same has been indicated in FIG. 1 by the arrow B. The paper web 1' which is pre-folded during its passage between the folding rolls 2 and 3, then during the subsequent passage between the folding worms 9, 10 and 11 is folded in a substantially zig-zag shaped configuration and temporarily deposited upon a deposit device 12.

Figure 2:
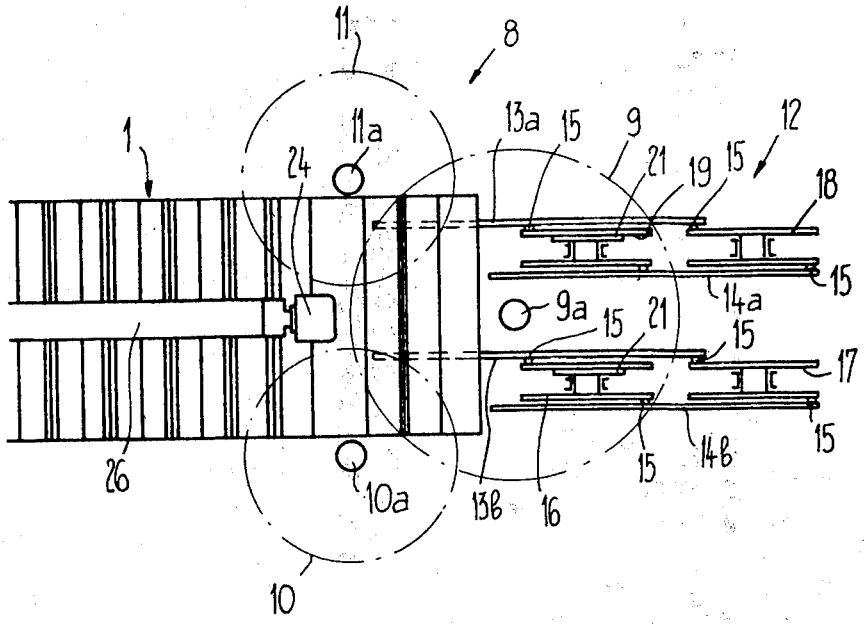
FIG. 2 is a plan view of the apparatus of FIG. 1.

The deposit or deposition device 12 will be seen to comprise two rod pairs 13*a*, 13*b* and 14*a*, 14*b*, as particularly well seen by referring to FIG. 2. The rods of each rod pair 13*a*, 13*b* and 14*a*, 14*b* are moved essentially parallel to one another in a manner to be described more fully hereinafter and serve, during such movement, temporarily as support means for a number of stacked sheets 7. The rods 13*a*, 13*b*, 14*a*, 14*b* are rotatably secured by means of the bearing journals 15 in each case at the one side of drive drums 16, 17, 18 and 19, respectively. Both of the drive drums 16 and 19 are rotatably driven in counterclockwise direction by a drive motor 20 with the aid of gearing 21 or equivalent structure. Both of the other drums 17 and 18 are supported to be freely rotatable in a bearing 22.

During the rotation of the drums 16, 17, 18 and 19 the rod pairs 13*a*, 13*b* and 14*a*, 14*b* are entrainably moved in such a manner that they alternately are introduced, for a certain period of time, into the path of travel of the paper web 1', so that there can form at the rod pairs in each case a partial stack 23, as particularly evident by referring to FIG. 1. Each partial stack 23 consists of a number of superimposed sheets 7.

Each partial stack 23 is engaged at the region of its one side by a gripper or gripper element 24 of a transport device 25 before the rod pair 13*a*, 13*b* or 14*a*, 14*b*, as the case may be, supporting such partial stack 23 moves away from beneath the partial stack 23. The transport device 25 is of known design and can be constructed, by way of illustration and not limitation, in the manner disclosed in German Patent Publication No. 2,922,450 and the corresponding commonly assigned copending United States application Ser. No. 051,344, filed June 25, 1979 now U.S. Pat. No. 4,320,894, granted Mar. 23, 1982. The individual grippers 24 of the transport device 25 are arranged behind one another in the conveying direction and at a mutual spacing from one another and secured to a revolving traction element which is guided within a guide channel 26 shown in FIG. 1. The zig-zag folded paper web, hereinafter conveniently designated by reference character 1, is now transported away by the transport device 25, and, as already mentioned, each gripper or gripper element 24 seizes together a number of sheets.

Figure 3:
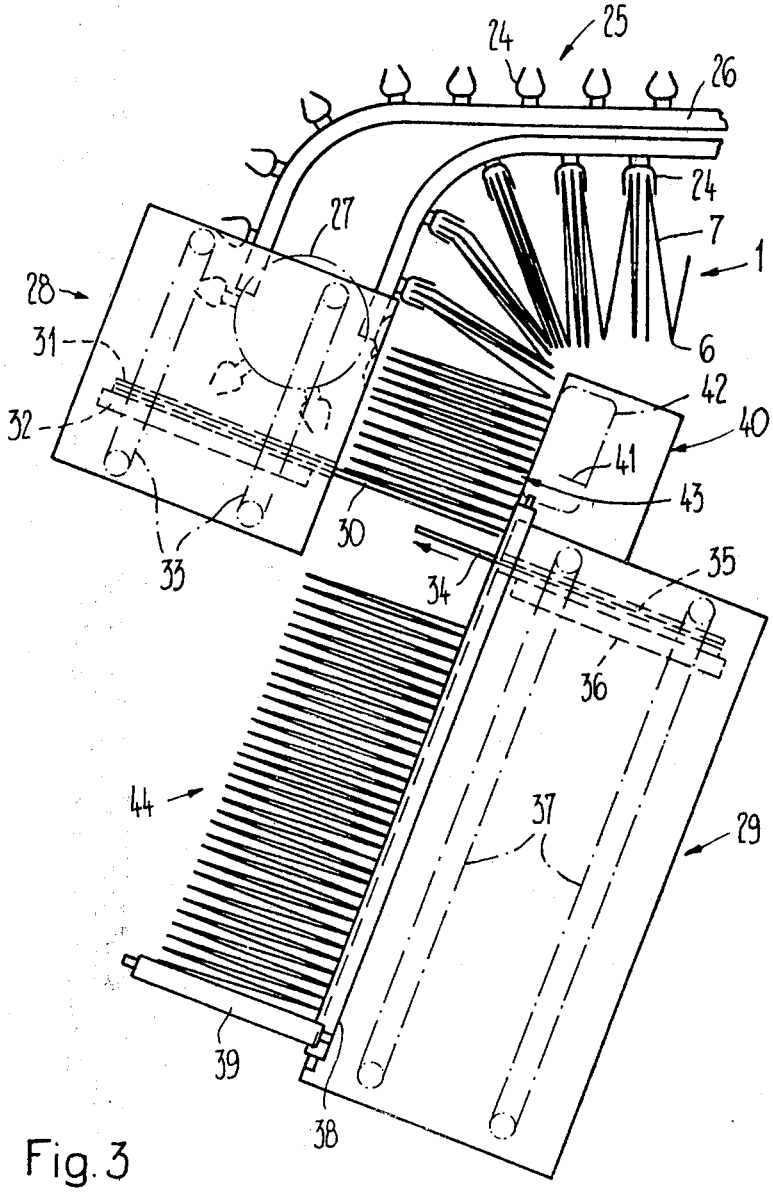
FIGS. 3 and 4 illustrate during different working phases a stacking device for the paper web which has been folded in the apparatus of FIG. 1.
Figure 4:
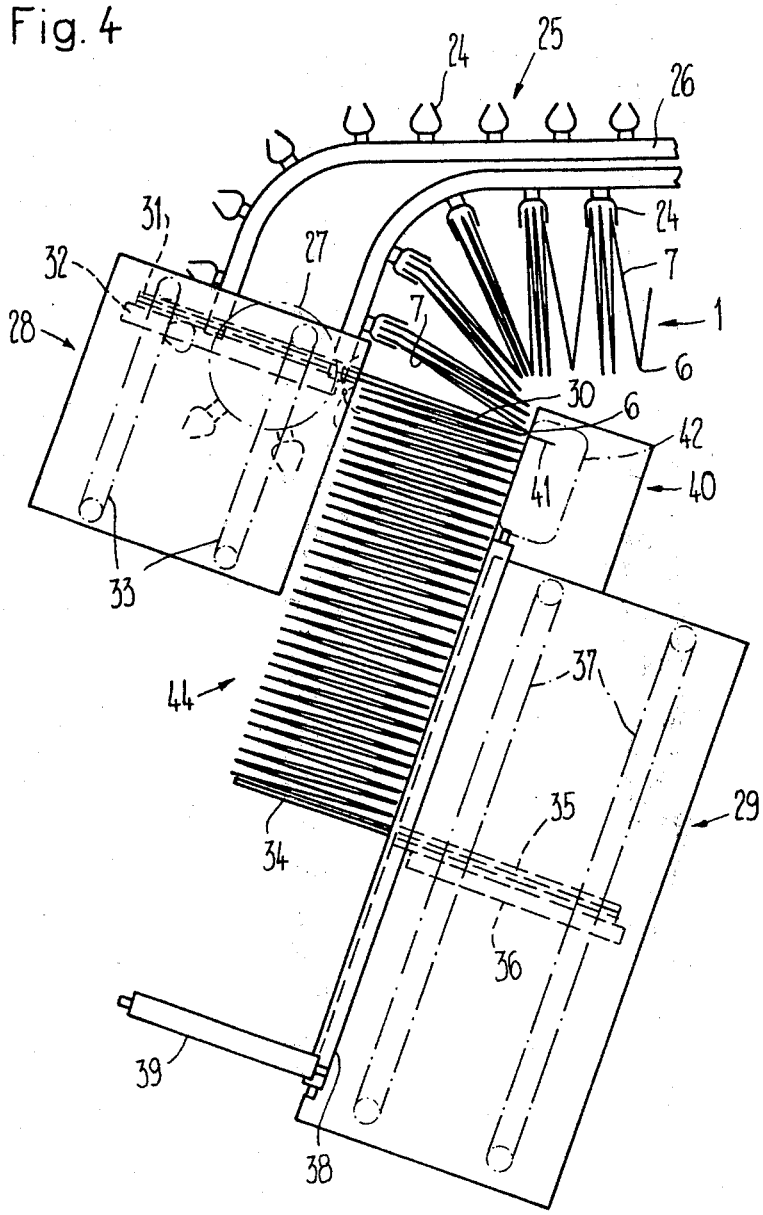

As best seen by referring to FIGS. 3 and 4, the transport device 25, which is guided at one end over a deflecting wheel or gear 27 or equivalent structure, conveys the paper web 1 to an intermediate stacking device 28 and a stacking device 29. The intermediate stacking device 28 possesses a preferably bifurcated or fork-shaped constructed support element 30 which is guided within a guide or guide means 31 and is moved to-and-fro by a pneumatic drive cylinder 32 within such guide means 31. The support element 30, guide means 31 and pneumatic drive cylinder or cylinder unit 32 are movable up and down by means of an only schematically illustrated but conventional lifting and lowering device 33, also sometimes simply referred to as an elevational displacement device.

The stacking device 29, just as was the case for the intermediate stacking device 28, likewise possesses a preferably bifurcated support element 34 which is guided in a guide or guide means 35 and can be driven to move to-and-fro by means of a pneumatic drive cylinder 36. The support element 34, guide means 35 and pneumatic drive cylinder 36 can be raised and lowered by means of a likewise only schematically illustrated lifting and lowering device 37. Furthermore, there are also provided rotatably mounted support rolls 38 as well as support rolls 39, the function of which will be described more fully hereinafter. Additionally, there is provided a separation or cutter device 40 containing the schematically illustrated separation element or cutter 41, for instance in the form of a rotating separator disc. This separator element 41 is moved along the path of travel generally indicated by reference character 42.

In FIG. 3 the support element 30 is shown in its extended position. The paper web 1 infed by the transport device 25 and released by the grippers 24 now is intermediately stacked into a partial stack 43 upon such support element or support means 30. The previously finished formed stack 44, which bears at its lower end at the support rolls 39 and laterally at the support rolls 38, is now transported away in the meantime in a direction located perpendicular to the plane of the drawing, for instance by driving the support rolls 39 or by means of a suitable pusher device. The support element 34 which is moved back following the transfer of the finished stack 44 onto the support rolls 39, is again moved into the upper end or terminal position by the elevational displacement device or lifting and lowering device 37, where it again can be extended by the action of the pneumatic drive cylinder 36. The support element 30 of the intermediate stacking device 28 is lowered by means of the lifting and lowering device 33 in accordance with the increasing height of the partial stack 43 and transfers at its lower end position the partial stack 43 to the support element 34 of the stacking device 29. Thereafter, the support element 30 is retracted and again moved back into its upper end or terminal position, as best seen by referring to FIG. 4. The support element 34 of the stacking device 29 is now lowered in accordance with the increase in the height of the stack 44 reposing thereon. If the support element 34 has reached its lower end position, then there is accomplished the already described transfer of the finished stack 44 to the support rolls 39.

If the stack 44 formed upon the support element 34 has reached the desired height, then the support element 30 of the intermediate stacking device 28 is again ejected or extended, as such has been illustrated in FIG. 4. Now there is formed a further partial stack upon this support element 30, as the same has already been described. The separator or cutter element 41 is now located opposite the support element 30 and severs the uppermost sheet of the finished stack 44 from the next following sheet 7, and specifically, at the connection location or fold 6 between both of these sheets.

In the described manner there is then formed from the paper web 1, continuously infed by the transport device 25, individual stacks 44 which are now intermediately stored or can be infed to a further processing device.

Based upon the illustrations of FIGS. 5, 6 and 7 there will now be described in detail the formation of multisheet products by placing on top of one another a plurality of paper webs which have been folded in zig-zag fashion in the previously described manner.

In order to place onto one another the different paper webs there is provided a drum member 45, whose shaft 45*a* is rotatably mounted and can be driven by a suitable drive device 46 so as to rotate in the direction of the arrow C. At the circumference of the drum 45 there are arranged radially protruding support elements 47 which are disposed in spaced relationship from one another along the circumference of such drum or drum member 45. These web-like support elements 47 extend in the axial direction of the drum member 45 practically over its entire width.

The drum member 45 possesses three infeed or inlet sections 48, 49 and 50 arranged adjacent one another in the axial direction of such drum member, as well as a removal section or portion 51 which is offset in the axial direction of the drum member 45 in relation to the neighboring inlet section or portion 50. Leading to each inlet or infeed section 48, 49 and 50 is a transport device 52, 53 and 54, respectively. The structure of each transport device 52, 53 and 54 corresponds to the construction of the transport device 25 illustrated and described above with reference to FIGS. 1 to 4, and likewise possesses individual grippers or gripper elements 55 arranged in spaced relationship from one another. Each transport device 52, 53 and 54 interconnects the drum member 45 with a supply source for a paper web, as the same has been illustrated in conjunction with FIG. 6. In such FIG. 6 this supply source is constituted by individual stacks 44, 44', which for instance previously have been produced in the manner described heretofore in conjunction with FIGS. 3 and 4. The paper webs stacked into the individual stacks 44, 44' are assembled together in known manner into an endless web by means of the schematically illustrated connecting or linking device 56.

However, it is also conceivable to infeed to the drum member 45 the paper webs arriving from the printing press and folded in the manner explained previously in conjunction with the description of FIGS. 1 and 2, without accomplishing any prior formation of individual stacks. The individual paper webs which are to be placed upon one another, designated by reference characters 1*a*, 1*b* and 1*c*, are now delivered by means of the operatively associated transport devices 52, 53 and 54 to the infeed sections or portions 48, 49 and 50 and placed upon the support elements 47 in such a manner that each second fold location 6 bears upon a support element 47, as the same has been shown in FIG. 6. Between each two neighboring support elements 47 there thus are located two sheets 7. The paper webs 1*a*, 1*b*, 1*c* are guided in a manner not here further described so as to move in an essentially helical-shaped configuration upon the drum member or drum 45, and the pitch of the helical or screw lines is not constant and becomes null at the infeed region of the webs 1*a*, 1*b* and 1*c*. Consequently, there is rendered possible a continuous placement of the paper webs on top of one another. As soon as the web 1*a* which has been placed at the infeed or inlet location 48 upon the drum member 45 arrives at the region of the second infeed location 49, there is deposited onto the first web 1*a* the second web 1*b*, as evident from the showing of FIG. 6. Both of the superimposed webs 1*a* and 1*b* now arrive at the third inlet or infeed location 50, where the third web 1*c* is placed upon both of the already superimposed webs 1*a* and 1*b*. It should be understood that in this manner it is also possible to stack upon one another in superimposed fashion more or less than three webs, and for each web there must be provided an appropriate infeed section or portion.

Figure 6:
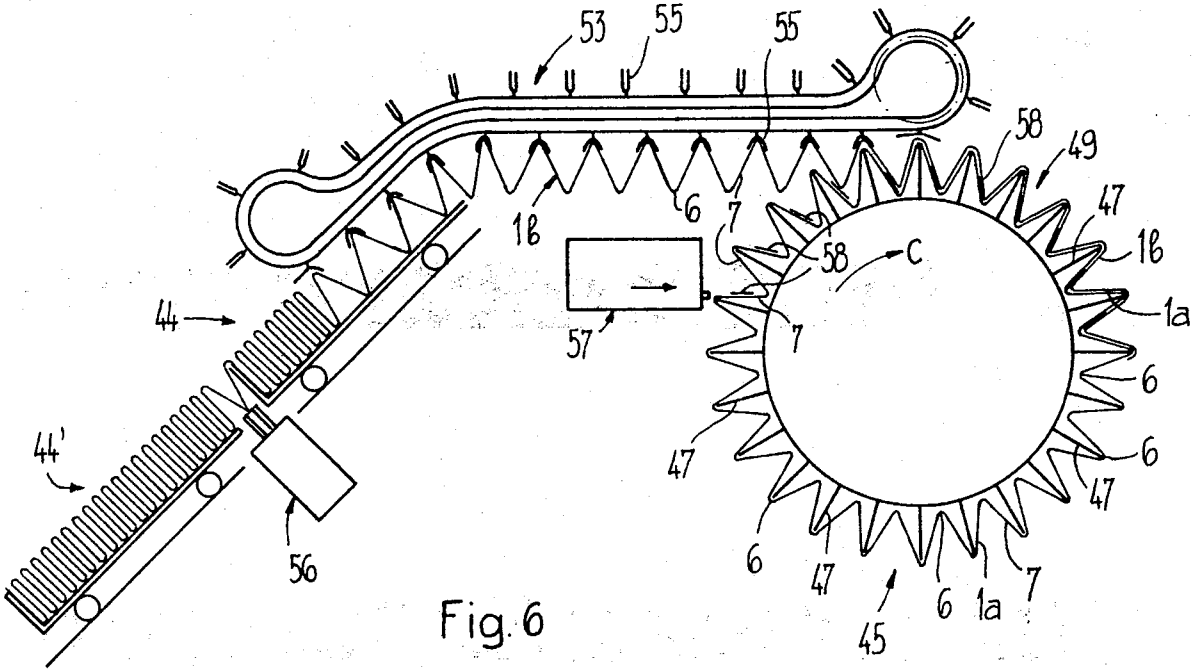
FIG. 6 is a sectional view of the arrangement of FIG. 5, taken substantially along the line VI—VI thereof.
Figure 7:
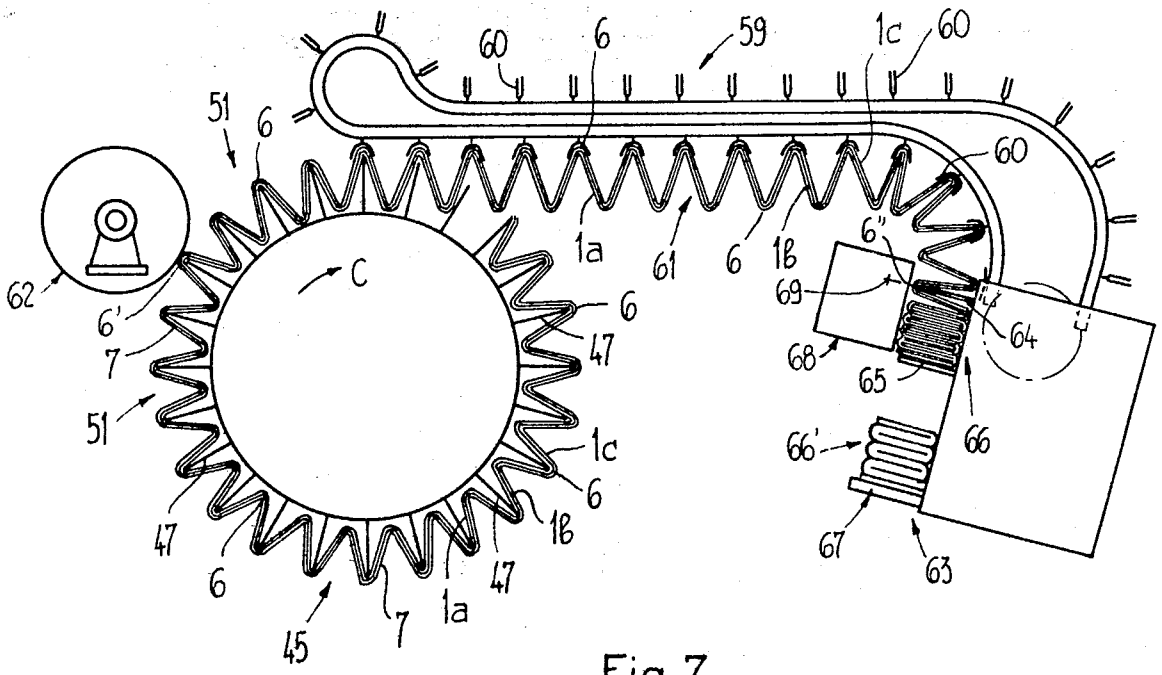
FIG. 7 is a sectional view of the arrangement of FIG. 5, taken substantially along the line VII—VII thereof.

As illustrated in FIG. 6 it is possible to provide the schematically shown stuffing or insertion apparatus 57 which stuffs an insert or supplement 58 or the like between both of the sheets 7 located between two neighboring support elements 47. Of course, there could be provided a greater number of stuffing apparatuses or devices 57. The position of the stuffing apparatus or apparatuses 57 depends upon the location where the finished printed product should have inserted therein such insert 58 or the like.

The paper webs 1*a*, 1*b* and 1*c* which have been placed upon one another in the previously described manner now arrive at the removal section or portion 51 of the drum member 45, where such superimposed webs are acted upon by a transport device or transport means 59. This transport device 59 corresponds in its construction to the transport device 25 shown in FIGS. 1 to 4. As illustrated in FIG. 7, the grippers 60 engage the superimposed webs, designated by reference character 61, at the region of the fold location 6 bearing upon the support elements 47 and lift the webs from the drum member 45. Before the superimposed webs 1*a*, 1*b*, 1*c* are engaged by the grippers 60, there can be accomplished a connection between the sheets, for instance binding or stitching of the sheets, at the fold locations or lines 6 bearing upon the support elements 47. To this end reference character 62 schematically represents a stitching or binding apparatus which interconnects with one another the overlying webs at the fold location designated by reference character 6'. However, there can be dispensed with any such connection operation.

The structure 61 composed of the three superimposed webs is then delivered by the transport device 59 to a stack forming device 63. This stack forming device 63 is essentially of the same construction as the stacking device illustrated and explained previously in conjunction with the description of FIGS. 3 and 4. As such, it is unnecessary to here again furnish any detailed description of such stack forming device 63. Equally, there are also provided two support elements 64 and 65, which can be extended and retracted. During the outfeed of a finished formed stack 66 bearing upon the support element 65 the arriving structure is temporarily stacked upon the other support element 64. The finished formed stack 66 is transferred from the support element 65 to an outfeed conveyor or transport device 67, for instance a band conveyor or a roller track. This outfeed conveyor or transport device 67 guides the stack, designated by reference character 66', in a direction extending essentially at right angles to the plane of the drawing of FIG. 7, as best seen by referring to FIG. 5.

In order to separate the arriving continuous structure 61 there is provided a separator device 68 having a separator element 69, for instance a rotating separation disc, which corresponds to the separator device 40 illustrated in FIGS. 3 and 4. By means of the separator element or cutter 69 there are severed the overlying or superimposed webs at certain fold locations or lines designated by reference character 6'' at which there was not accomplished previously any connection operation or stitching.

Figure 5:
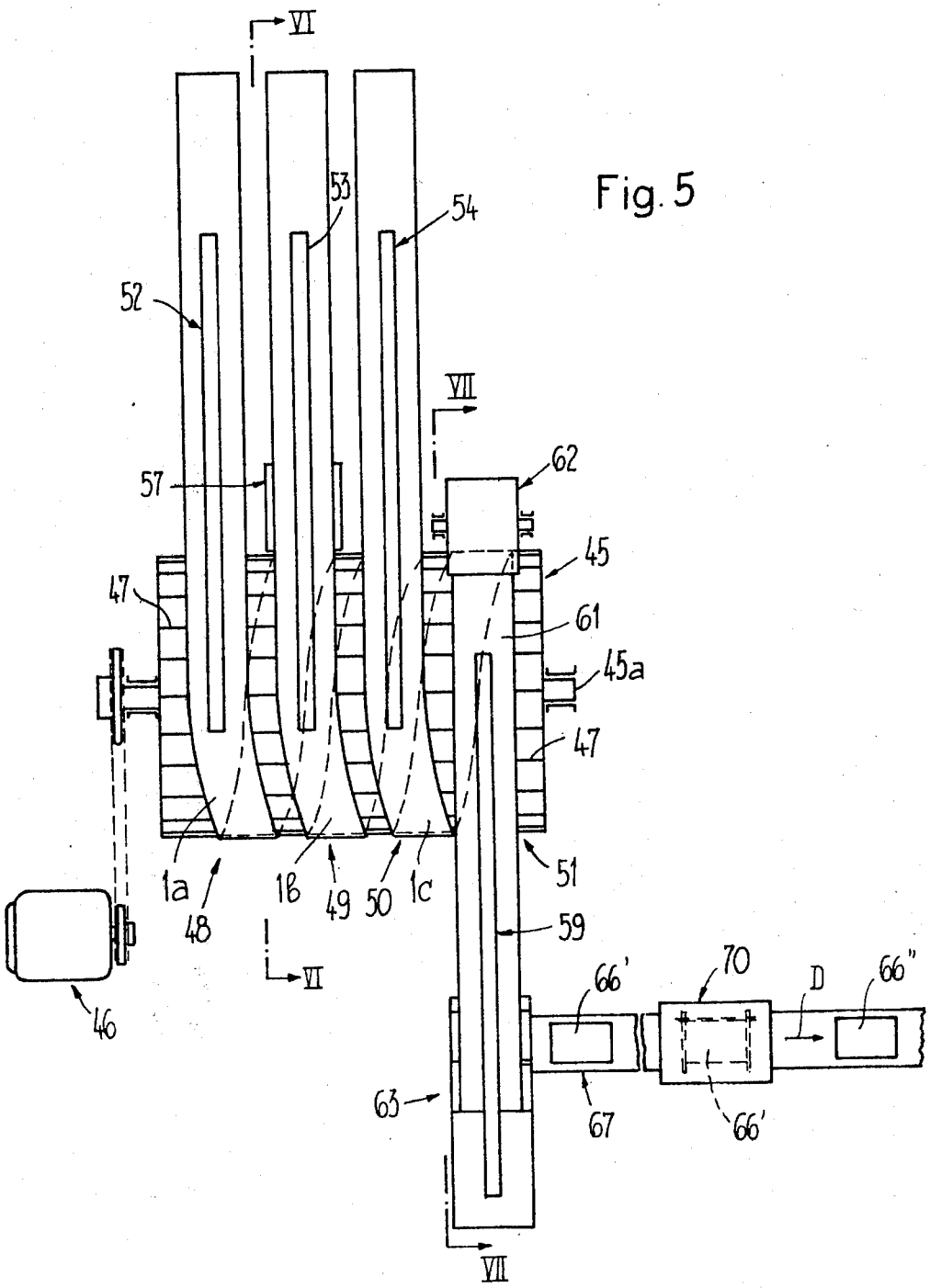
FIG. 5 is a top plan view of an apparatus for placing on top of one another or superimposing a number of zig-zag shaped, folded webs.

As best seen by referring to FIG. 5, the completed stacks 66' travel through a cutter apparatus 70 of known construction, and which then cuts the stack at the three sides at which the webs have not been interconnected with one another. Consequently, the individual multi-sheet, finished assembled printed products of a stack 66' are also separated from one another at the side opposite their spine. The stacks 66'' departing from the cutter apparatus 70 are thus formed by individual, mutually separated printed products. Under circumstances it would also be conceivable to individually separate from one another the individual, hanging together finished printed products forming the structure 61 prior to the stacking work.

While utilising the previously explained principles it is possible to readily carry out other variants or modifications of the described exemplary embodiment. Thus, for instance, the individual webs 1*a*, 1*b* and 1*c* which are to be placed upon one another need not, as illustrated, be single ply, rather also can be multi-ply or multi-layered.

The support device for supporting the webs also can be constructed differently than illustrated. Instead of arranging the support elements 47 at the circumference of a drum member 45, i.e. at or in a curved surface, it is also possible to arrange the support elements 47 at or in a planar surface, for instance in the manner of the wrungs of a ladder.

Additionally, it is conceivable when using a drum member 45 to provide only a single infeed or inlet location which serves for the delivery of all of the webs to the drum member. With such solution there is no longer possible however a continuous placement of the webs on top of one another, i.e. superimposing of the webs. In the event that the individual webs are suspended at one another prior to deposition at the drum, and each partial web has a length corresponding to the circumferential length of the drum member or drum, then the web assembled from such partial webs can be wound multiply or multilayered upon such drum member in the circumferential direction thereof.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A method of forming multi-sheet printed products, especially newspapers, magazines and periodicals, comprising the steps of:

supporting at least one first zig-zag folded web, constituted by printed sheets which are interconnected with one another at fold lines extending transversely with respect to the lengthwise direction of the web, at fold lines at spaced locations of said first zig-zag folded web;

thereafter and concurrently while said first web is supported at said fold lines substantially in a zig-zag form laying upon said first web at least one further zig-zag folded web likewise constituted by printed sheets which are interconnected with one another at fold lines extending transversely with respect to the lengthwise direction of the web, with the fold lines of said at least one further web being in alignment with the fold lines of said first web; and supporting said at least one further web at fold lines thereof at the same locations as said first web.

2. The method as defined in claim 1, further including the steps of:

supporting the webs at each second fold line thereof.

3. The method as defined in claim 1, further including the steps of:

laying at least two of said further webs in succession upon said first web.

4. The method as defined in claim 1, further including the steps of:

stacking in a substantially zig-zag configuration the superimposed webs.

5. The method as defined in claim 1, further including the steps of:

cutting-through the superimposed webs at individual fold lines.

6. The method as defined in claim 5, further including the steps of:

cutting-through the superimposed webs at each second fold line.

7. The method as defined in claim 1, further including the steps of:

interconnecting the superimposed webs at predetermined fold lines.

8. The method as defined in claim 7, wherein:

the superimposed webs are interconnected at each second fold line.

9. The method as defined in claim 7, further including the steps of:

interconnecting the superimposed webs at said predetermined fold lines by stitching.

10. The method as defined in claim 1, further including the steps of:

stuffing an insert between two interconnected sheets.

11. An apparatus for forming multi-sheet printed products, especially newspapers, magazines and periodicals, comprising:

a support device for supporting at spaced support locations at least one first zig-zag folded web constituted by printed sheets interconnected with one another at fold lines extending transversely with respect to the lengthwise direction of the web;

said support device supporting said first web at predetermined fold lines thereof;

means for laying upon said supported first web and concurrently while said first web is supported at said predetermined fold lines substantially in a zig-zag form at least one further zig-zag folded web constituted by printed sheets interconnected with one another at fold lines extending transversely with respect to the lengthwise direction of the web;

the fold lines of said at least one further web being in alignment with the fold lines of said first web; and said support device supporting said at least one further web at predetermined fold lines at said spaced support locations.

12. The apparatus as defined in claim 11, wherein:

said support device supports said webs at each second fold line.

13. The apparatus as defined in claim 11, wherein:

said support device comprises individual support elements arranged in spaced relationship; and said webs bearing upon said support elements at said predetermined fold lines.

14. The apparatus as defined in claim 13, wherein:

said support device comprises a revolving driven drum member having an axis of rotation; and said support elements being arranged at the circumference of said drum member.

15. The apparatus as defined in claim 14, wherein:

said drum member possesses at least two infeed portions for the individual webs and a removal portion for the superimposed webs;

said infeed portions and said removal portion being offset with respect to one another in the direction of the axis of rotation of said drum member; and said webs being guided in a substantially helical-shaped path of travel about said drum member.

16. The apparatus as defined in claim 11, further including:

an infeed device having a predetermined conveying direction provided for each web and arranged upstream of the support device; and said infeed device possessing controllable grippers arranged behind one another, viewed in said conveying direction of the infeed device, and which engage the web.

17. The apparatus as defined in claim 11, further including:

an outfeed device having a predetermined conveying direction arranged downstream of the support device; and said outfeed device possessing controllable grippers arranged behind one another in the conveying direction of the outfeed device and which engage the superimposed webs.

18. The apparatus as defined in claim 11, further including:

a stacking device arranged after the support device and serving for the substantially zig-zag shaped stacking of the superimposed webs.

19. The apparatus as defined in claim 11, further including:

a separator device for cutting the superimposed webs at least at predetermined fold lines thereof.

20. The apparatus as defined in claim 19, wherein:

said separator device serves to cut superimposed webs at each second fold line.

21. The apparatus as defined in claim 11, further including:

means for interconnecting the superimposed webs at predetermined fold lines.

22. The apparatus as defined in claim 21, wherein:

said interconnecting means serve to interconnect the webs at each second fold line.

23. The apparatus as defined in claim 21, wherein:

said interconnecting means interconnect the webs at said predetermined fold lines which bear upon said support elements.

24. The apparatus as defined in claim 21, wherein:

said interconnecting means comprise stitching means.

25. The apparatus as defined in claim 11, further including:

a stuffing device arranged at the region of the support device and serving for the insertion of inserts between two interconnected sheets.

26. The apparatus as defined in claim 11, comprising:

said laying means serves for laying at least two of said further zig-zag folded webs in succession upon said supported first web.

27. An apparatus for forming multi-sheet printed products, especially newspapers and magazines, comprising:

a support device for supporting at spaced support locations at least two substantially zig-zag folded, mutually aligned and superimposed webs;

each of said webs being formed by sheets interconnected with one another at fold locations extending transversely with respect to the web lengthwise direction;

said support device supporting the webs at predetermined fold locations;

said support device comprising individual support elements arranged in spaced relationship;

said webs bearing upon said support elements at said predetermined fold locations;

said support device further comprising a revolving driven drum member having an axis of rotation;

said support elements being arranged at the circumference of said drum member;

said drum member possessing at least two infeed portions for the individual webs and a removal portion for the superimposed webs;

said infeed portions and said removal portion being offset with respect to one another in the direction of the axis of rotation of said drum member; and said webs being guided in a substantially helical-shaped path of travel about said drum member.

28. A method of forming multi-sheet printed products, especially newspapers and magazines, comprising the steps of:

placing in superimposed aligned fashion on top of one another at least two substantially zig-zag folded webs;

each of said webs being constituted by sheets which are interconnected with one another at fold locations extending transversely with respect to the web lengthwise direction;

supporting the webs at the fold locations at spaced locations; and guiding the webs, as they are placed in superimposed fashion on top of one another, along an essentially helical-shaped path of travel.

* * * * *